United States Patent [19]

Morton

[11] 4,089,077

[45] May 16, 1978

[54] COMBINATION TOOL

[76] Inventor: Arthur P. Morton, 2712 Bowling Green Dr., Vienna, Va. 22180

[21] Appl. No.: 732,066

[22] Filed: Oct. 13, 1976

[51] Int. Cl.[2] ..... B25F 1/00

[52] U.S. Cl. ..... 7/138; 7/166; 7/169

[58] Field of Search ..... 7/1 G; 81/119, 121 B, 81/125.1

[56] References Cited

U.S. PATENT DOCUMENTS

| | | | |
|---|---|---|---|
| 496,913 | 5/1893 | Shoe | 81/121 B X |
| 648,324 | 4/1900 | Wolfe | 81/125.1 X |
| 1,584,422 | 5/1926 | Bate | 81/121 B |
| 2,106,749 | 2/1938 | Knight | 7/1 G |
| 2,839,822 | 6/1958 | Dillingham et al. | 7/1 G |

FOREIGN PATENT DOCUMENTS

| | | | |
|---|---|---|---|
| 588,833 | 2/1925 | France | 81/119 |
| 19,885 of | 1896 | United Kingdom | 81/121 B |

*Primary Examiner*—James L. Jones, Jr.
*Assistant Examiner*—James G. Smith
*Attorney, Agent, or Firm*—Birch, Stewart, Kolasch & Birch

[57] ABSTRACT

The present invention relates to a combination tool comprising a wrench-end portion and a jaw-end portion, said wrench-end portion and said jaw-end portion being connected by a neck, said wrench-end portion containing an aperture which is adapted for engagement with a nut and said jaw-end portion containing a tooth member and a lower lip member which cooperate to facilitate the removal of a propeller from a propeller shaft.

6 Claims, 8 Drawing Figures

COMBINATION TOOL

The present invention relates to a combination tool which can be utilized for replacing the propeller of a motor. More particularly, the present invention is directed to a combination wrench which is effective in replacing the propeller of a Mercury engine for a motor boat.

Various tools which can be utilized for replacing a propeller from a propeller shaft of a motor are well known in the art. However, in performing such an operation in connection with Mercury engines for motor boats, it is necessary to utilize several different tools to remove the propeller from the shaft, thereby substantially complicating the overall procedure. This is particularly true when the propeller becomes damaged during operation, and it is necessary to remove the damaged propeller and replace it with a new propeller while the boat is bouncing about on the surface of the water. The required use of three of four different tools in order to remove the propeller from the propeller shaft of the Mercury engine renders the removal of said propeller very difficult and is also very time-consuming.

Accordingly, an object of the present invention is to provide a single tool which is effective in removing and replacing a propeller from the propeller shaft of a Mercury engine.

Another object of the present invention is to provide a combination tool which makes the replacement of the propeller for a Mercury engine very easy and much less time-consuming.

A further object of the present invention is to provide a combination wrench-type tool which not only is effective in providing several functions, but is so designed that each of its functions is more effectively achieved than the individual tools utilized in the prior art.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1A:
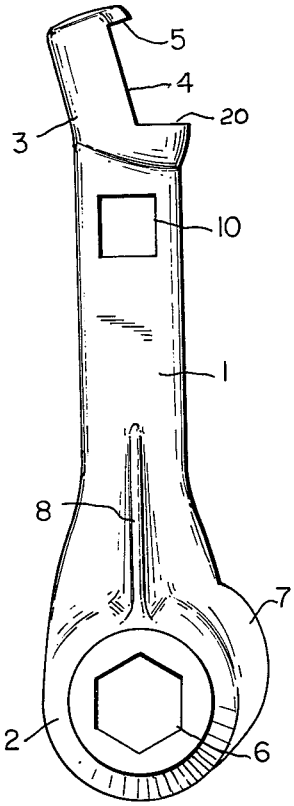
FIGS. 1*a*, 1*b*, and 1*c* show one embodiment of the combination wrench-type tool of the present invention.
Figure 1B:
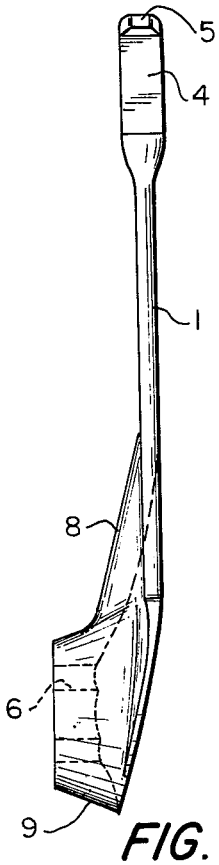
Figure 1C:
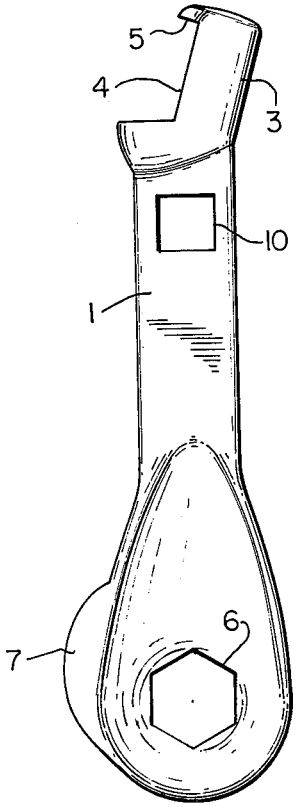

The present invention will now be described in connection with the drawings wherein like reference numerals are used throughout the various views to indicate like parts. The combination wrench-type tool of the present invention, with particular reference to FIGS. 1*a*, 1*b*, and 1*c* comprises a wrench-portion 2 which is disposed at one end of the combination tool and a jaw portion 3 disposed at the other end of the combination tool. The end portions of said tool are connected by a neck 1 which is of sufficient length to enable the operator to effectively grasp the combination tool. A hexagon-shaped aperture 6 is provided at the wrench end portion of the tool, said hexagon-shaped aperture being adapted to engage a similarly shaped nut for removing said nut from the propeller shaft of the Mercury engine. The wrench-end portion of the combination tool is also provided with a flange 7 which extends from the end of the combination tool and contains a half-moon shape. The flange 7 functions as a screw-type device and thus can be effectively used for unscrewing or screwing the gas filler cap. A web 8 which extends from the wrench-end portion of the combination tool to some point along the neck of said tool provides additional strength and support to the wrench-end portion of the tool. The jaw-end portion of the combination tool 3 is provided with a mouth 4 which contains a tapered tooth 5 and a lip 20, said jaw-end portion being particularly effective as a prying means for removing the propeller from the propeller shaft of a Mercury engine as will be described hereinafter. The neck of the combination tool also contains a square aperture 10 having a side length of $\frac{5}{8}$ of an inch, said aperture being utilized for removing a threaded drain plug.

Figure 2A:
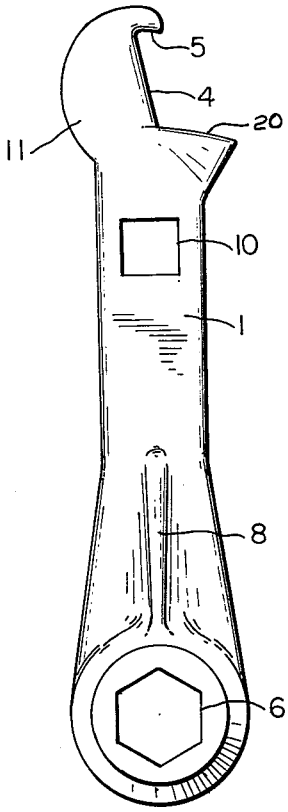
FIGS. 2*a*, 2*b*, and 2*c* show another embodiment of the combination wrench-type tool of the present invention.
Figure 2B:
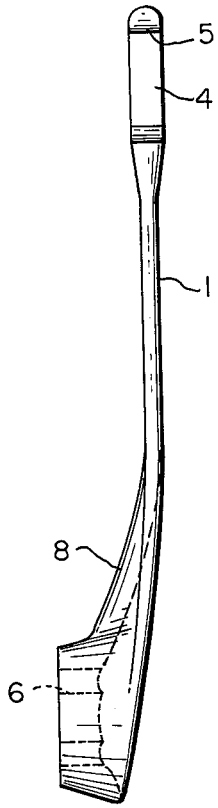
Figure 2C:
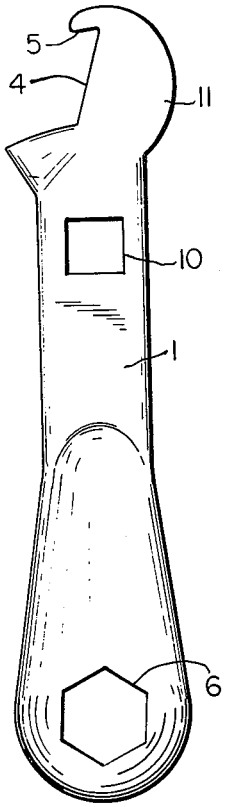

FIGS. 2*a*, 2*b*, and 2*c* show another embodiment of the combination wrench-type tool of the present invention. In this particular embodiment, the jaw-end portion of the combination tool is provided with a flange 11 having a half-moon shape which not only provides the function of the flange 7 shown in FIG. 1, but further facilitates the movement of the jaw-end portion of the combination tool within the exhaust cone for releasing tabs of a lock washer which is utilized for locking the propeller to the propeller shaft. This end of the combination tool can also be used like a screwdriver to open the gas and water filler caps and where a normal screw groove is not provided, the rounded head portion 11 can readily fit between the two ears which can be disposed on the filler cap. In both of the embodiments of FIGS. 1 and 2, the wrench-end portion of the combination tool is canted from the neck in order to enable this end portion to fit into the cone of the propeller disposed on the shaft of the Mercury engine.

Figure 3:
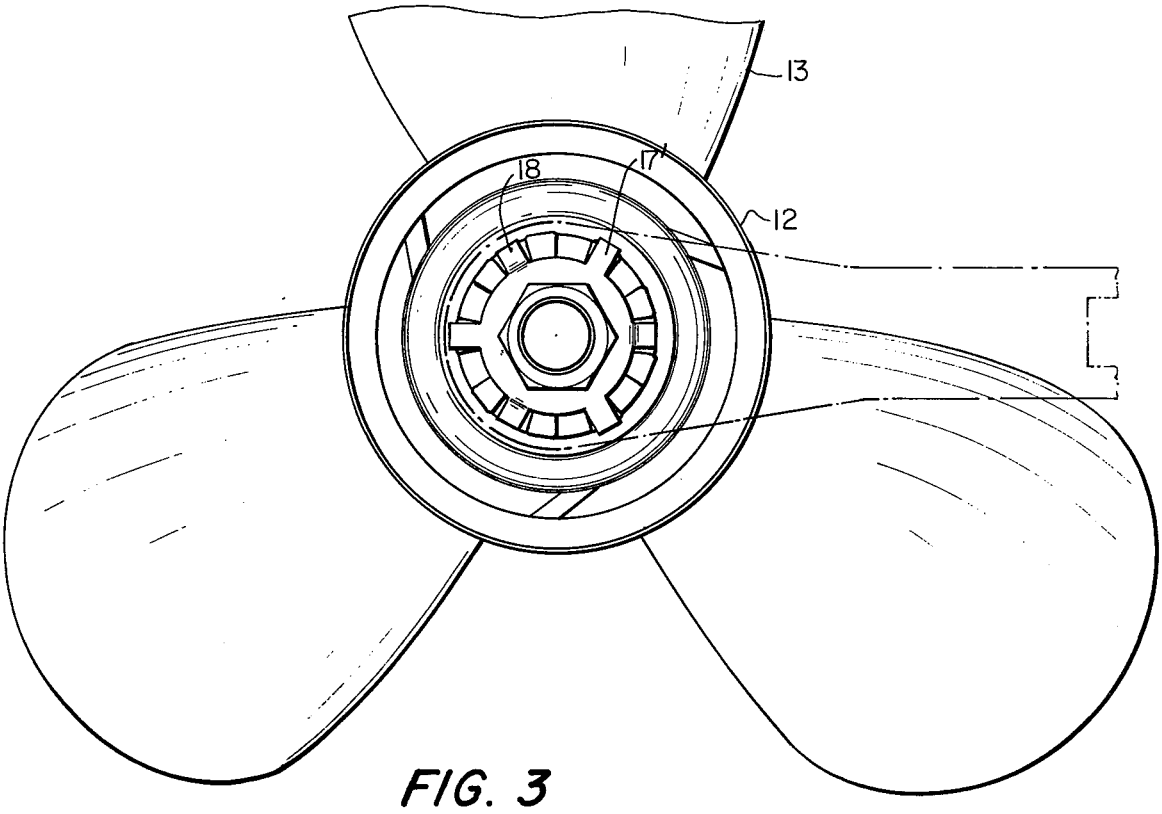
FIG. 3 shows an end view of the exhaust cone of the propeller housing of a Mercury engine.
Figure 4:
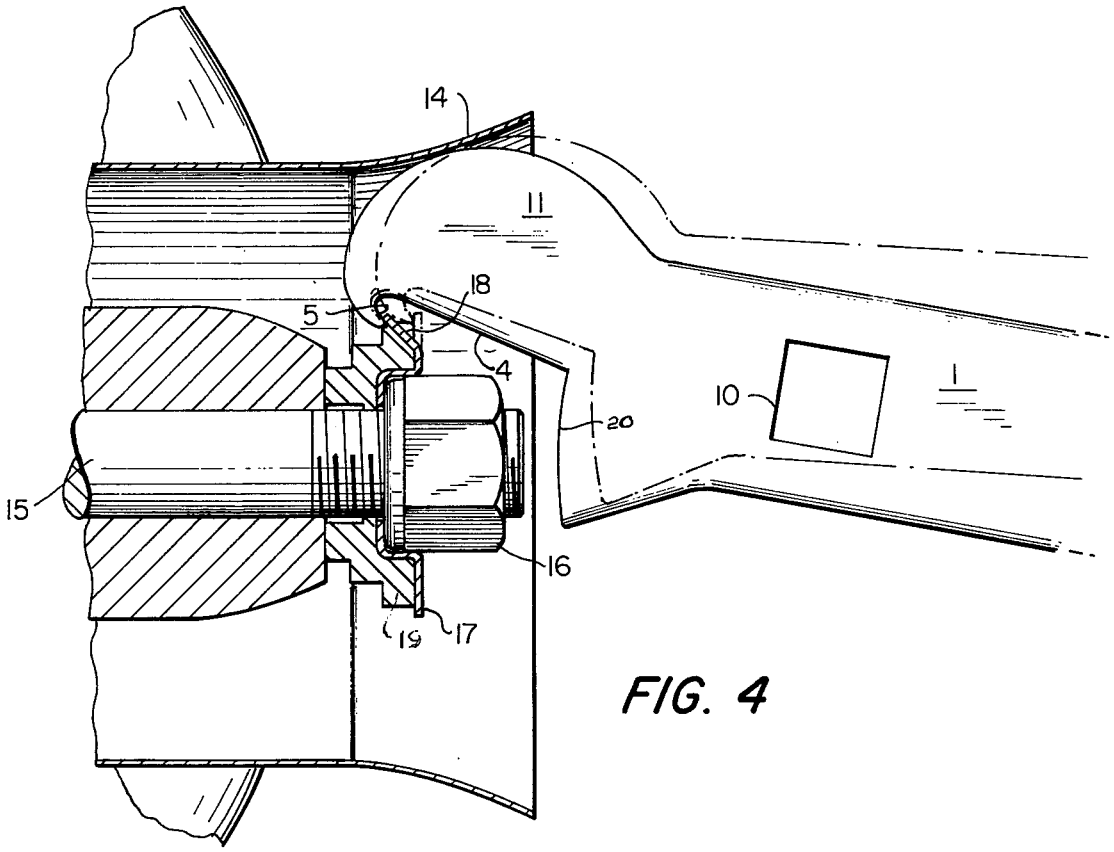
FIG. 4 shows a profile view, in section, of the exhaust cone, propeller and propeller shaft and how the combination tool of the present invention is utilized to remove the propeller from the propeller shaft.

FIGS. 3 and 4 show how the propeller of a Mercury engine is fixed to the propeller shaft and, in addition, how the wrench-type combination tool of the present invention is utilized to replace a damaged propeller with a new propeller. As can be seen in FIGS. 3 and 4, the propeller shaft is mounted in an aperture provided in the exhaust cone of the propeller. After the propeller shaft has been threaded into the aperture provided in the exhaust cone of the propeller, a spline washer is mounted on the end portion of the propeller shaft utilizing a plurality of splines which are provided on the rear side of the spline washer, said splines engaging with matching splines which are disposed around the periphery of the propeller shaft. A lock washer 17 is then positioned within a depression provided in the spline washer around the periphery of the propeller shaft. The lock washer 17 contains a plurality of tabs 17', most of which are in alignment with corresponding tabs which are provided on the spline washer. However, at least one tab 18, advantageously three tabs 18, are in alignment with a depressed portion disposed on the spline washer. Thus, by forcing the tabs 18 of the lock washer in the depressed portions of the spline washer, the lock washer is held in place in alignment with the spline washer which, in turn, is fixed to the shaft by the splines referred to hereinabove. The lock washer contains a hexagon-shaped depression which is adapted to receive a nut containing a hexagonal shape. Thus, in securing the propeller to the propeller shaft, the nut is screwed onto the shaft until it is screwed into the depression provided in the lock washer, and then the nut is further tightened until the lock washer which moves in unison with the nut during the tightening process is aligned so that at least one of the tabs 18 is disposed above the depressions provided in the spline washer. Thus, by tapping the tabs 18 into said depression, the entire unit is locked together.

It is at this point where the wrench-type combination tool of the present invention comes into play. Thus, assuming that it is necessary to change the propeller on a Mercury engine, it is first necessary to pry up the tabs 18 which have been depressed into the depressions provided in the spline washer. As shown in FIG. 4, the wrench-like combination tool is inserted into the cone of the propeller housing and the tooth 5 is utilized to engage the end of the tab 18 and pry said tab away from the spline washer so that it is substantially in alignment with tabs 17. The curved surface 11 of the jaw-end portion of the combination tool of the present invention greatly facilitates the prying-up of the tabs 18 because said surface smoothly glides along the inner surface of the exhaust cone 14. Thus, the rounded portion 11 provides a cam-type action in releasing the tabs 18 of the lock washer. The bottom lip portion 20 of the combination tool rides against the top center of the propeller shaft during the prying-up of the tabs 18 by the tooth member 5. In the embodiment shown in FIG. 2, the tongue member 20 is sloped to slide across the top of the shaft, thereby facilitating the prying-up of the tabs 18. Once the tabs 18 have been pried up so that they are in substantial alignment with tabs 17, the wrench-end portion 2 of the combination tool can be utilized to remove the nut 16 from the bolt 15. The removal of the nut 16 also frees the lock washer and the spline washer from the propeller shaft, thereby enabling the removal of the propeller and exhaust cone from the propeller shaft. Thus, with the use of a single combination tool as defined by the present invention, a damaged propeller can be replaced with a new propeller with relative ease and in a relatively short period of time when compared to tools which are presently utilized in the prior art.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

It is claimed:

1. A combination tool to facilitate the removal of a propeller from a propeller shaft of a motorboat engine comprising a wrench-end portion and a prying-end means, said wrench-end portion and said prying-end means being connected by a neck portion, said wrench-end portion containing an aperture which is adapted for engagement with a nut disposed on the propeller shaft, said aperture lying in a different plane than said neck portion and said prying-end means containing an upper tooth member disposed on the end of the prying-end means and a lower lip member disposed intermediate the upper tooth member and the neck portion, said upper tooth member and said lower tooth member being joined by an intermediate member, said upper tooth member and said lower lip member disposed in the same plane and projecting in substantially the same direction from said intermediate member to form a mouth portion at said prying-end means, and said lower lip member having a continuous working surface which enables it to provide for sliding engagement with the propeller shaft, said upper tooth member and said lower lip member cooperating to facilitate said removal of the propeller from the propeller shaft.

2. The combination tool of claim 1, wherein the neck member is provided with a square-shaped aperture.

3. The combination tool of claim 2, wherein the wrench-end portion of the combination tool is canted from said neck portion and a web member is provided to connect the wrench-end portion to said neck member.

4. The combination tool of claim 1, wherein the wrench-end portion is provided with a flange member which contains a half-moon shape.

5. The combination tool of claim 1, wherein the prying-end portion opposite said tooth and lip member has a flange provided with a half-moon shape.

6. The combination tool of claim 1, wherein the prying-end portion is offset relative to the neck portion to facilitate engagement of the lower lip member with the propeller shaft during a prying operation.

* * * * *